US011719017B2

(12) United States Patent
Williams

(10) Patent No.: US 11,719,017 B2
(45) Date of Patent: Aug. 8, 2023

(54) INFLATABLE DRIVE THROUGH TUNNEL SYSTEM

(71) Applicant: Thomas Williams, Montgomery, TX (US)

(72) Inventor: Thomas Williams, Montgomery, TX (US)

( * ) Notice: Subject to any disclaimer, the term of this patent is extended or adjusted under 35 U.S.C. 154(b) by 309 days.

(21) Appl. No.: 17/209,330

(22) Filed: Mar. 23, 2021

(65) Prior Publication Data

US 2021/0301549 A1 Sep. 30, 2021

Related U.S. Application Data

(60) Provisional application No. 63/001,021, filed on Mar. 27, 2020.

(51) Int. Cl.

| | |
|---|---|
| ***E04H 15/20*** | (2006.01) |
| ***E04H 14/00*** | (2006.01) |
| ***E04H 1/12*** | (2006.01) |
| ***E04H 15/22*** | (2006.01) |
| *E04H 3/08* | (2006.01) |

(52) U.S. Cl.

CPC ..... *E04H 15/22* (2013.01); *E04H 1/1205* (2013.01); *E04H 14/00* (2013.01); *E04H 3/08* (2013.01); *E04H 2015/201* (2013.01)

(58) Field of Classification Search

CPC ..... E04H 15/22; E04H 2015/201; E04H 2015/204; E04H 15/20; E04H 14/00; E04H 1/1205; E04H 1/1277

See application file for complete search history.

(56) References Cited

U.S. PATENT DOCUMENTS

| | | | | |
|---|---|---|---|---|
| 2,782,794 A * | 2/1957 | White | E04H 15/20 52/2.19 |
| 2,830,606 A * | 4/1958 | Daugherty | E04H 15/20 52/2.14 |
| 2,854,014 A * | 9/1958 | Hasselquist | E04H 15/20 441/40 |
| 3,647,026 A * | 3/1972 | Alexander | E04H 14/00 221/268 |
| 4,805,355 A | 2/1989 | Plant | |
| 5,052,519 A * | 10/1991 | Woodham | E05G 7/008 186/37 |
| 5,122,400 A | 6/1992 | Stewart | |
| 5,331,991 A | 7/1994 | Nilsson | |
| 5,509,927 A | 4/1996 | Epstein et al. | |
| 5,570,544 A | 11/1996 | Hale et al. | |
| 5,706,846 A | 1/1998 | Sutton | |

(Continued)

FOREIGN PATENT DOCUMENTS

| | | |
|---|---|---|
| DE | 19506200 | 8/1996 |
| DE | 202007018365 | 6/2008 |

*Primary Examiner* — Robert Canfield

(74) *Attorney, Agent, or Firm* — Bushman Werner, P.C.

(57) ABSTRACT

An inflatable drive through tunnel system comprised of an inflatable main tunnel and an inflatable positive pressure booth area for performing simple medical diagnostic tests or the like. A patient can drive into the inflatable tunnel. Medical personnel can take samples from patients who remain in their vehicles. The medical personnel can then store the samples in the positive pressure booth area. The positive pressure ensures that outside contaminants are not brought into the booth through the air when the personnel enter and leave the booth.

9 Claims, 7 Drawing Sheets

(56) References Cited

U.S. PATENT DOCUMENTS

| | | | | |
|---|---|---|---|---|
| 6,001,057 | A | 12/1999 | Bongiovanni et al. | |
| 6,438,900 | B1 * | 8/2002 | Page | E04H 15/22 52/2.16 |
| D652,885 | S * | 1/2012 | Frey | D21/834 |
| 8,479,452 | B2 | 7/2013 | Page | |
| 9,714,523 | B2 * | 7/2017 | Lilly, II | E04H 15/18 |
| 9,776,223 | B2 | 10/2017 | Rankin | |
| 9,869,110 | B2 * | 1/2018 | Krenzel | E04H 15/50 |
| 9,878,342 | B2 | 1/2018 | Wiliams | |
| 10,717,103 | B2 | 7/2020 | Williams | |
| 10,766,049 | B2 | 9/2020 | Williams | |
| 2002/0185064 | A1 | 12/2002 | Shutic | |
| 2003/0187082 | A1 | 10/2003 | Scherba | |
| 2007/0090629 | A1 | 4/2007 | Ohnstad et al. | |
| 2007/0095279 | A1 | 5/2007 | Langeman | |
| 2007/0101466 | A1 * | 5/2007 | Ferraro | E04H 15/20 D21/835 |
| 2010/0170162 | A1 * | 7/2010 | Pfeiffer | E04H 15/20 52/79.5 |
| 2010/0272915 | A1 | 10/2010 | Laws | |
| 2012/0131857 | A1 * | 5/2012 | Ross-da Silva | E04H 15/20 52/2.18 |
| 2013/0068851 | A1 * | 3/2013 | Young | A61M 35/25 52/2.13 |
| 2013/0196589 | A1 | 8/2013 | Ramsay et al. | |
| 2015/0017897 | A1 * | 1/2015 | Wiliams | E04H 1/1205 454/51 |
| 2016/0097214 | A1 * | 4/2016 | Ore | B65B 3/00 264/45.2 |
| 2017/0081867 | A1 * | 3/2017 | Wasson | E04H 15/20 |
| 2017/0156961 | A1 * | 6/2017 | Patel | E04H 1/1205 |
| 2018/0187409 | A1 | 7/2018 | Williams | |
| 2020/0079199 | A1 * | 3/2020 | Blueford | E04H 15/20 |
| 2020/0299984 | A1 * | 9/2020 | Williams | B60S 5/00 |
| 2021/0215041 | A1 * | 7/2021 | Scherba | E21D 9/14 |
| 2021/0348405 | A1 * | 11/2021 | Hadinger | E04H 1/005 |
| 2021/0364179 | A1 * | 11/2021 | Kipp | A61L 9/20 |
| 2022/0298816 | A1 * | 9/2022 | Henderson | E04H 15/20 |

* cited by examiner

INFLATABLE DRIVE THROUGH TUNNEL SYSTEM

CROSS REFERENCE TO RELATED APPLICATION

This application claims priority to U.S. Application No. 63/001,021 filed on Mar. 27, 2020 the disclosure of which is incorporated herein by reference for all purposes.

FIELD OF THE INVENTION

The present invention relates to an inflatable drive through tunnel system in which a positive pressure booth is connected to a drive through tunnel. More particularly, the present invention relates to an inflatable drive through tunnel system for use in administering simple medical diagnostic tests or treatments.

BACKGROUND OF THE INVENTION

Inflatable booths and tunnels have been used for a multitude of purposes. U.S. Pat. Nos. 9,878,342 and 10,766,049, both of which are incorporated herein by reference for all purpose disclose inflatable drive in booths for applying paint to a vehicle. U.S. Pat. No. 10,717,103, incorporated herein by reference for all purposes, discloses an inflatable booth used for spraying bed liner into a truck bed. U.S. patent application Ser. No. 15/398,056, incorporated herein by reference for all purposes, discloses an inflatable booth used in detecting dents in the body of a vehicle. Each of these prior art inflatable booths allows for a vehicle to be driven partially or completely through an inflatable structure.

The present invention utilizes an inflatable drive through tunnel and attached positive pressure booth to allow medical personnel to take medical samples for diagnostic tests directly from patients in their vehicles or to administer simple medical treatments, e.g. vaccinations.

SUMMARY OF THE INVENTION

In one aspect, the present invention relates to an inflatable drive through tunnel system.

In another aspect, the present invention relates to an inflatable drive through tunnel system comprised of a main tunnel and a positive pressure booth area. Medical personnel can take samples from patients who remain in their vehicles. The medical personnel can then store the samples in the positive pressure booth area. The positive pressure ensures that outside contaminants are not brought into the booth through the air when the personnel enter and leave the booth.

These and further features and advantages of the present invention will become apparent from the following detailed description, wherein reference is made to the figures in the accompanying drawings.

DETAILED DESCRIPTION OF PREFERRED EMBODIMENTS

Figure 1:
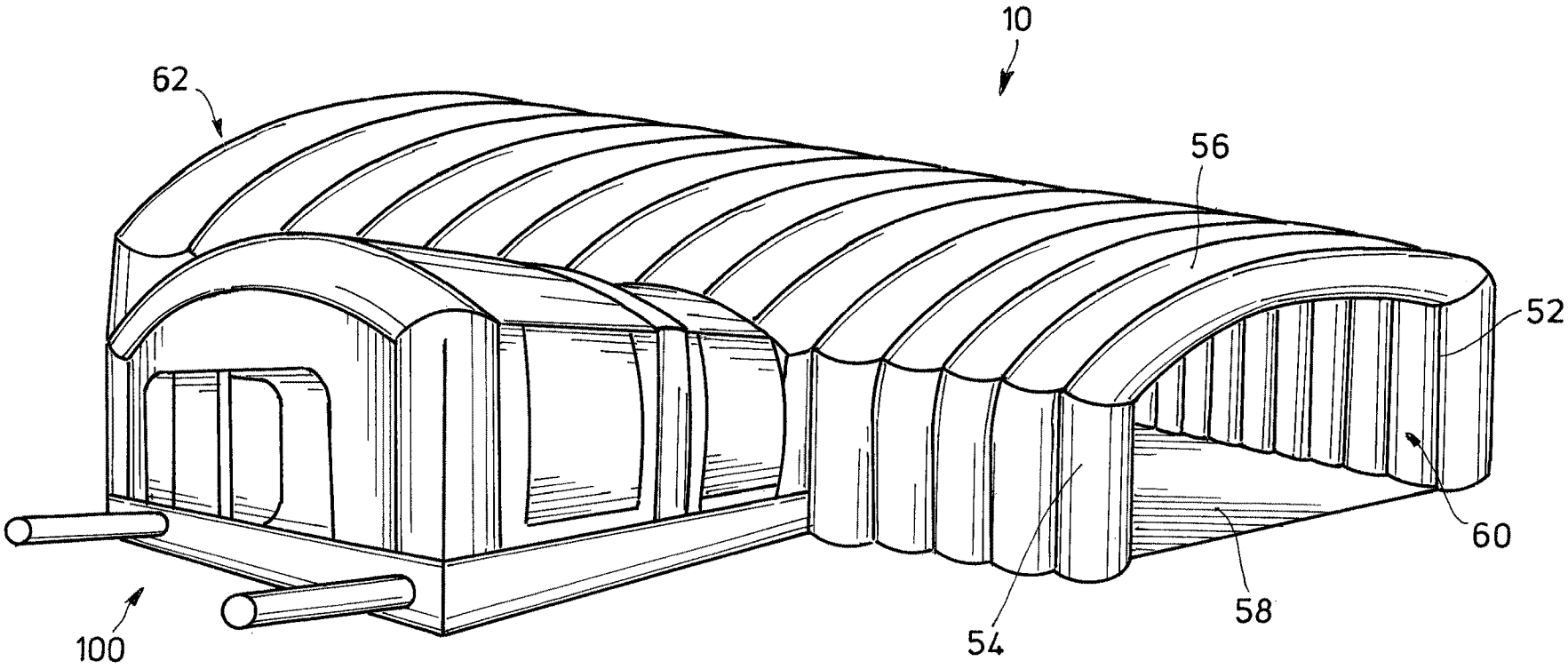
FIG. 1 is a perspective view of one embodiment of the system of the present invention including the inflatable tunnel and the inflatable positive pressure booth.
Figure 2:
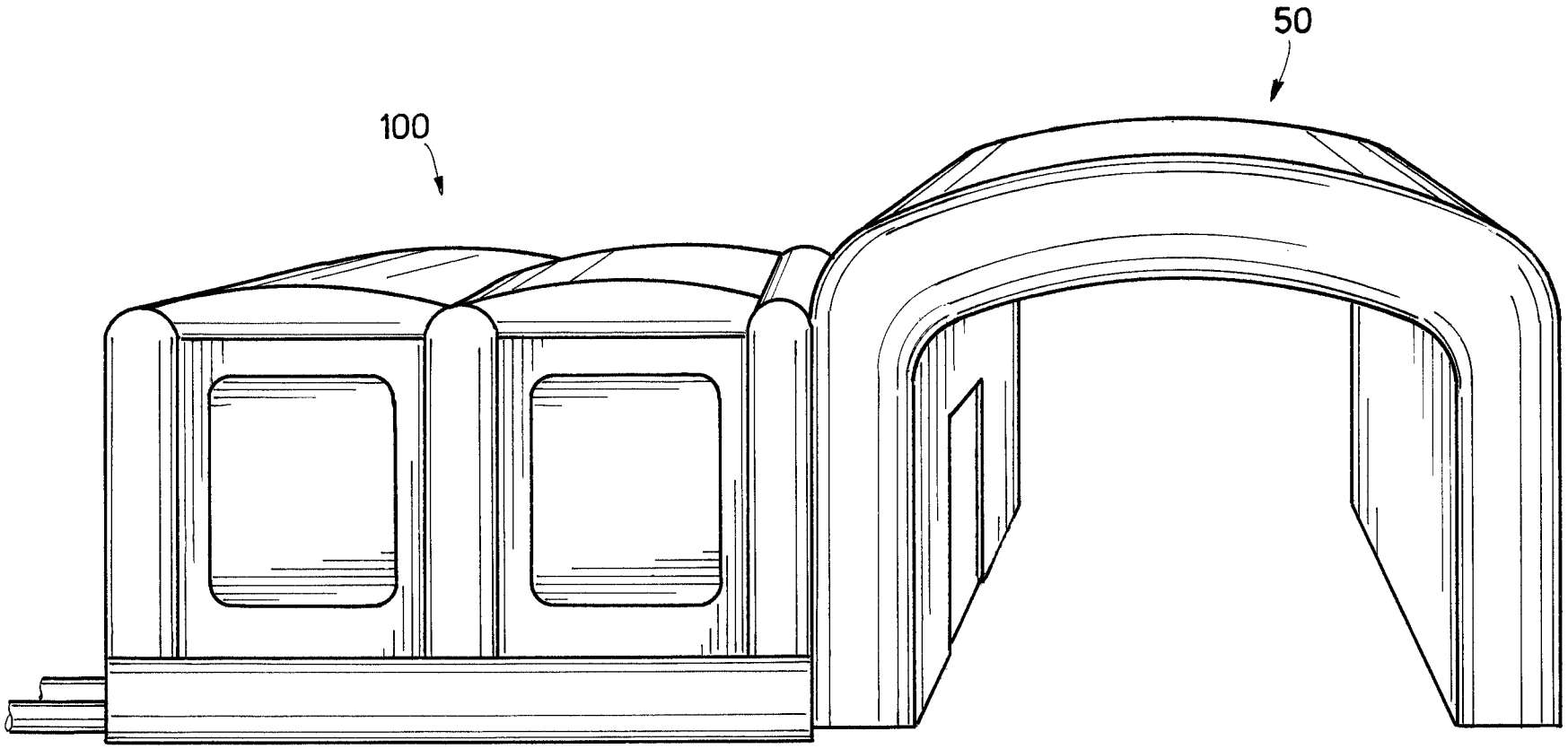
FIG. 2 is a front view of the system of FIG. 1.
Figure 3:
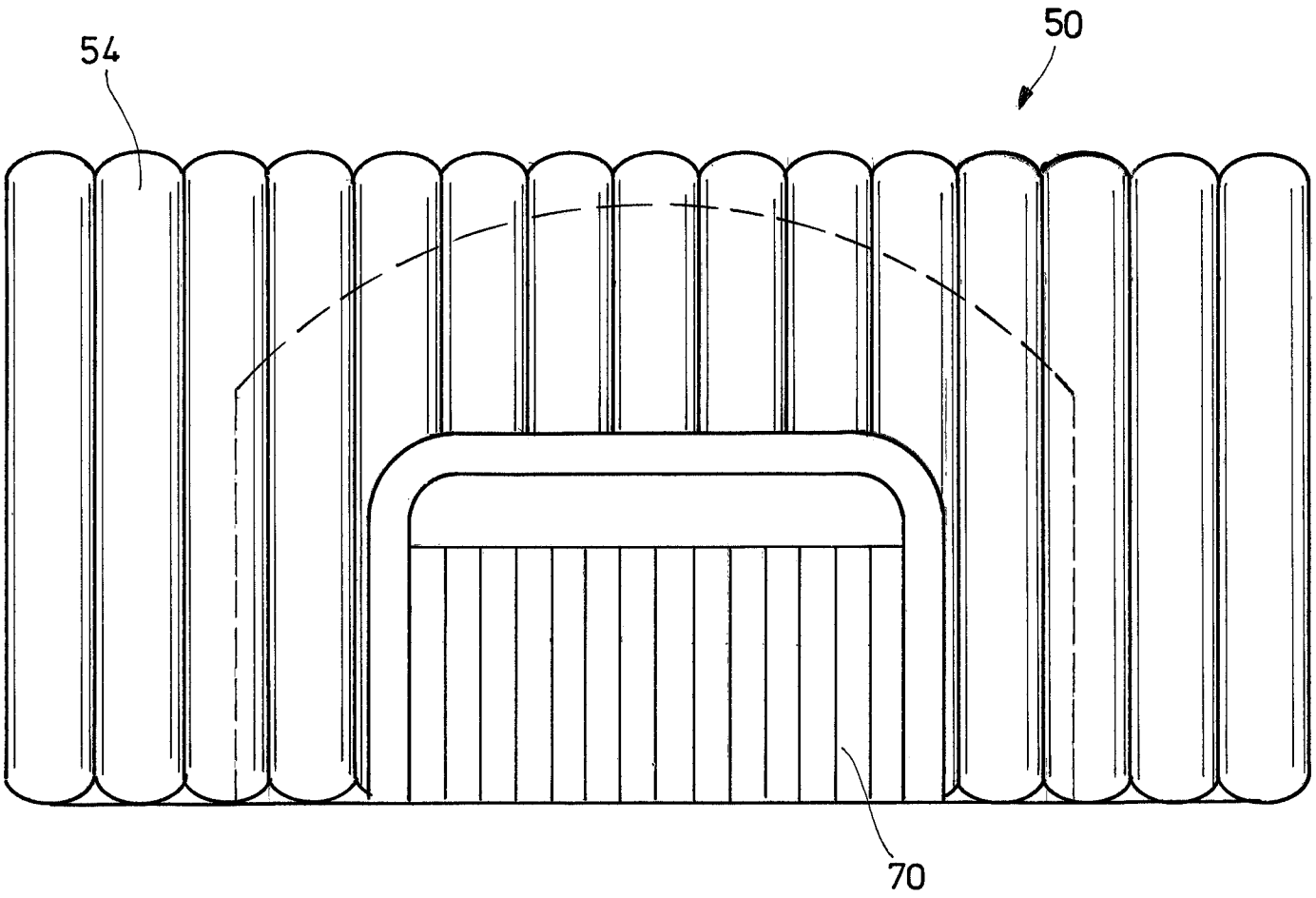
FIG. 3 is a side view of the tunnel portion of the system of FIG. 1 with the outline of where the positive pressure booth would be shown in dotted line.

Turning first to FIGS. 1-3 there is shown one embodiment of the inflatable drive through tunnel system of the present invention. System 10 comprises an inflatable drive through tunnel 50 and inflatable positive pressure booth 100. Tunnel 50 is comprised of inflatable walls 52 and 54, inflatable ceiling 56, and optionally, floor 58 which may be connected to walls 52 and 54 or may be a separate piece. There is an interior tunnel space formed between walls 52 and 54, ceiling 56 and either the ground or floor 58. The shape of tunnel 50 may be achieved from a series of connected inflatable tubes which are in open communication with one another such that the inflation of tunnel 50 can be accomplished from one air inlet. Tunnel 50 has openings 60 and 62 at opposite ends. The inflatable nature of tunnel 50 means that it is portable and easy to set-up in a desired location. In a preferred embodiment tunnel 50 is made of a durable antistatic vinyl material. As seen in FIG. 3, wall 54 has an opening 70 where positive pressure booth 100 can be connected.

Positive pressure booth 100 can be removably or permanently connected to tunnel 50. If removably connected, temporary fasteners such as hook-and-loop fabric, snaps, buttons, quick release connections, or the like may be positioned on booth 100 and tunnel 50 to allow booth 100 and tunnel 50 to be removably connected. Alternatively, the opening 70 may be sized such that the end of booth 100 fits snugly within opening 70 without the use of fastening mechanisms. If permanently connected, there may be an extra piece of material connecting the booth and the tunnel. Or the booth and tunnel may be formed together, such that they can both be inflated from a single point. In any event, it is preferred that booth 100 and tunnel 50 be connected in some fashion to eliminate gaps between booth 100 and tunnel 50. Tunnel 50 may vary in size but should be at least large enough that ordinary vehicles can drive through the entirety of tunnel 50. It will be understood that variations in dimension are contemplated within the scope of the present invention. For example, the exact length of tunnel 50 can vary, as can the exact position of port 70, and hence booth 100, along tunnel 50. It is generally preferred though that tunnel 50 be longer than the width of booth 100, and that booth 100 be positioned generally in the middle of the length of tunnel 50, so as to provide maximize the distance between booth 100 and the ends 60 and 62 of tunnel 50. Tunnel 50 may optionally include drapes, covers, or temporary wall structures positioned at or over openings 60 and 62.

Turning to FIGS. 4-7, there is shown the positive pressure booth 100 of the present invention. In one embodiment booth 100 comprises an inflatable frame 101, a roof 102, a floor 103, and a plurality of wall sections 104. Inflatable frame 101 provides structure to booth 100. Inflatable frame 101 allows booth 100 to be portable and easy to set-up. Inflatable frame 101 comprises a plurality of vertical supports 101*a*, each placed at opposite sides of booth 100 and parallel to each other. Inflatable frame 101 can further comprise a base support 101*b*, a first set of upper beams 101*c*, a second set of upper beams 101*d*, and one or more horizontal beams 101*e*. Roof 102 can be connected at the top portion of inflatable frame 101. If desired, roof 102 can comprise a translucent material that allows natural light to enter booth 100. Floor 103 is connected at the bottom of inflatable frame 101 and is preferably made of a durable plastic sheeting material including, but not limited to, high-density polyethylene.

Figure 4:
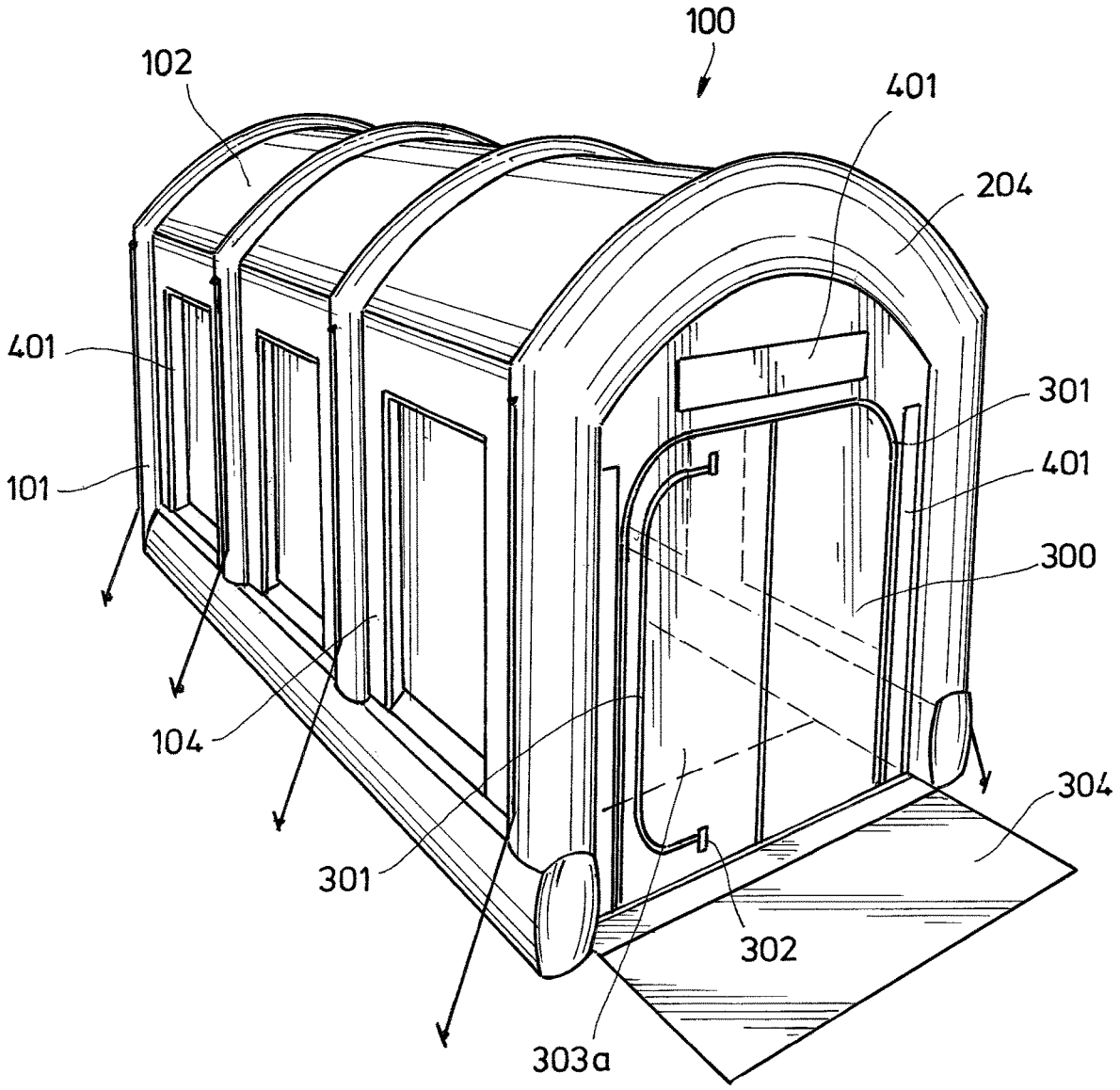
FIG. 4 is a front perspective view of one embodiment of the positive pressure booth of the present invention disconnected from the inflatable tunnel.

FIG. 4 shows wall 204 comprising an entry port 300. Entry port 300 can be a re-sealable opening sufficiently large for any medical or storage equipment desired. Entry port 300 may comprise a drape or cover having a slit for entering/leaving booth 100. Port 300 can have a smaller access opening in the form of resealable slit 301. Slit 301 can be in a variety of shapes, including but not limited to a C-shape, T-shape, or L-shape. Slit 301 is resealable and can be formed of a zipper fastener, hook and loop fabric, or other resealable means. In a preferred embodiment, slit 301 is formed of a zipper fastener. Entry port 300 can further comprise a first door 303*a*, and a mat 304. Door 303*a* can be a re-sealable passage that is used to enter and/or exit booth 100. As such door 303*a* can also comprise slit 301. Mat 304 can be a durable sheet material such as plastic or fabric placed directly below entry port 300. Mat 304 may also be placed such that it extends into interior space 105.

Booth 100 may also include exhaust panels 401 mounted in wall sections 104 or around entry port 300. Each exhaust panel can comprise a replaceable filter (not shown) such as those used in U.S. Pat. No. 9,878,342, incorporated herein by reference for all purposes.

Figure 5:
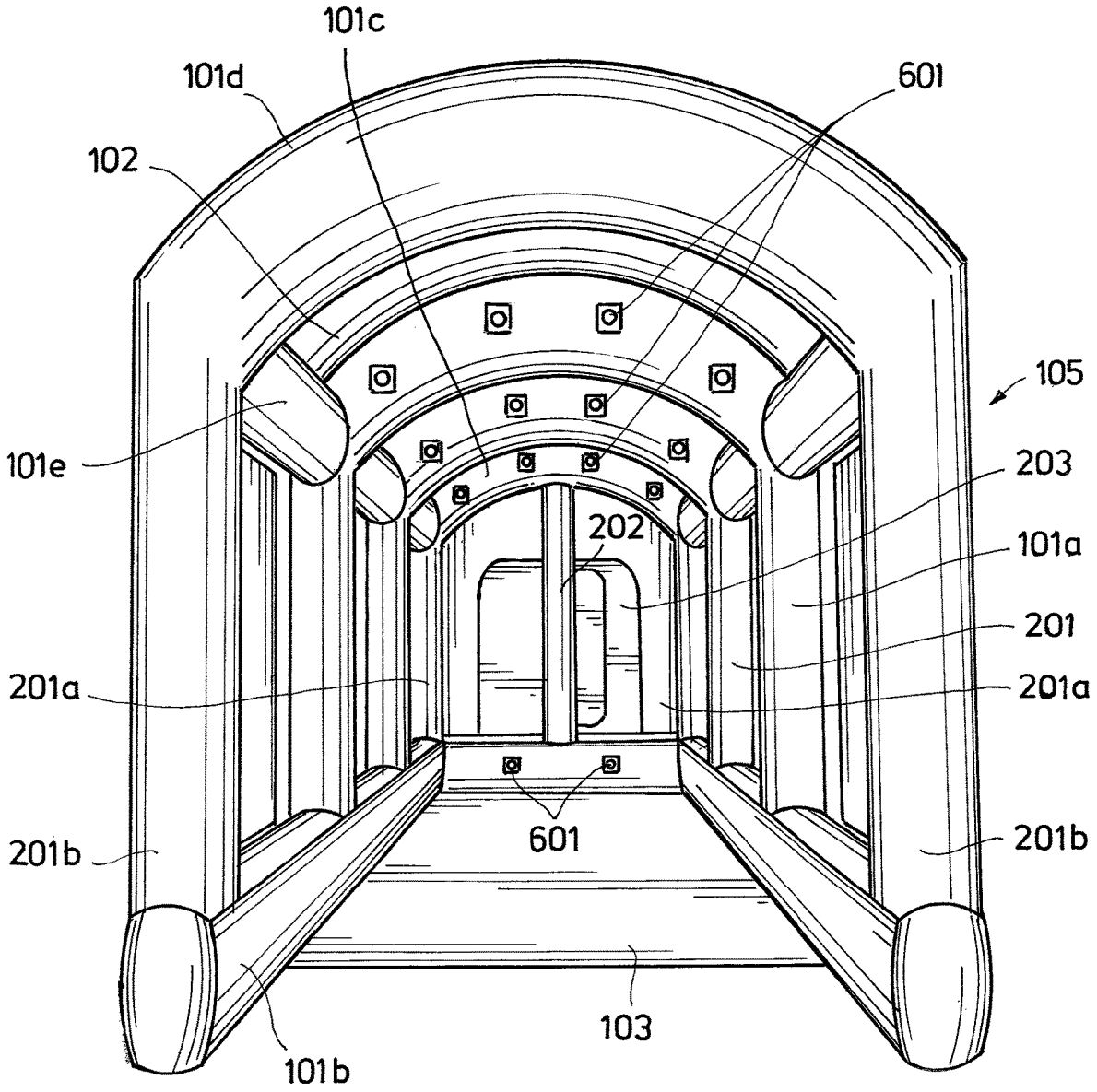
FIG. 5 is a view of the interior of the positive pressure booth of FIG. 4.

FIG. 5 shows the interior space 105 of booth 100. As can be seen, vertical supports 101*a* define the vertical boundaries of interior space 105. In one embodiment, vertical supports 101*a* can comprise corner supports 201, and middle support 202 positioned between corner supports 201*a*. Base support 101*b* is substantially in the shape of a horizontal "U" and is connected to each of vertical supports 101*a* at the bottom. In one embodiment, the base of the "U" of base support 101*b* is along the bottom of first wall 203. First upper beam 101*c* can connect a first set of corner supports 201*a* and middle support 202. Second upper beam 101*d* can connect a second set of corner supports 201*b*.

Additionally, a second set of corner supports 201*b* can be along a second wall 204. Horizontal beams 101*e* can connect first upper beam 101*c* and second upper beam 101*d* together. Further, upper beams 101*c* and 101*d* can form an arc at the top portion of booth 100. Further, middle support 202 in between base support 101*b* and first upper beam 101*c* can form an "I"-shaped structure. Such exemplary structure can allow booth 100 to have better wind resistance. In a preferred embodiment, vertical supports, base support, upper beams, and upper horizontal beams can be connected together such that air can pass between them, and they inflate and deflate together.

Inflatable frame 101 comprises a plurality of air vents 601. Air vents 601 can be openings that allow air to flow through interior space 105. As such, air vents 601 allow the air that is pumped in to inflate frame 101 to enter interior space 105 and create a positive pressure environment relative to that outside of booth 100. In a preferred embodiment, air vents 601 include filters which can capture and contain chemical and dust particulates such that they do not enter interior space 105. The filters are preferably removable for easier cleaning or replacement. To ensure that the booth stays at a positive pressure relative to the area outside the booth (including relative to the interior tunnel space of tunnel 50), the air is driven through exhaust panels and filters only by the relative pressure from within the booth. In other words, the air being blown in through vents 601 drives the air in the booth through the exhaust panels and filters. There are no external suction devices, fans, or the like which pull air out of the booth.

Figure 6:
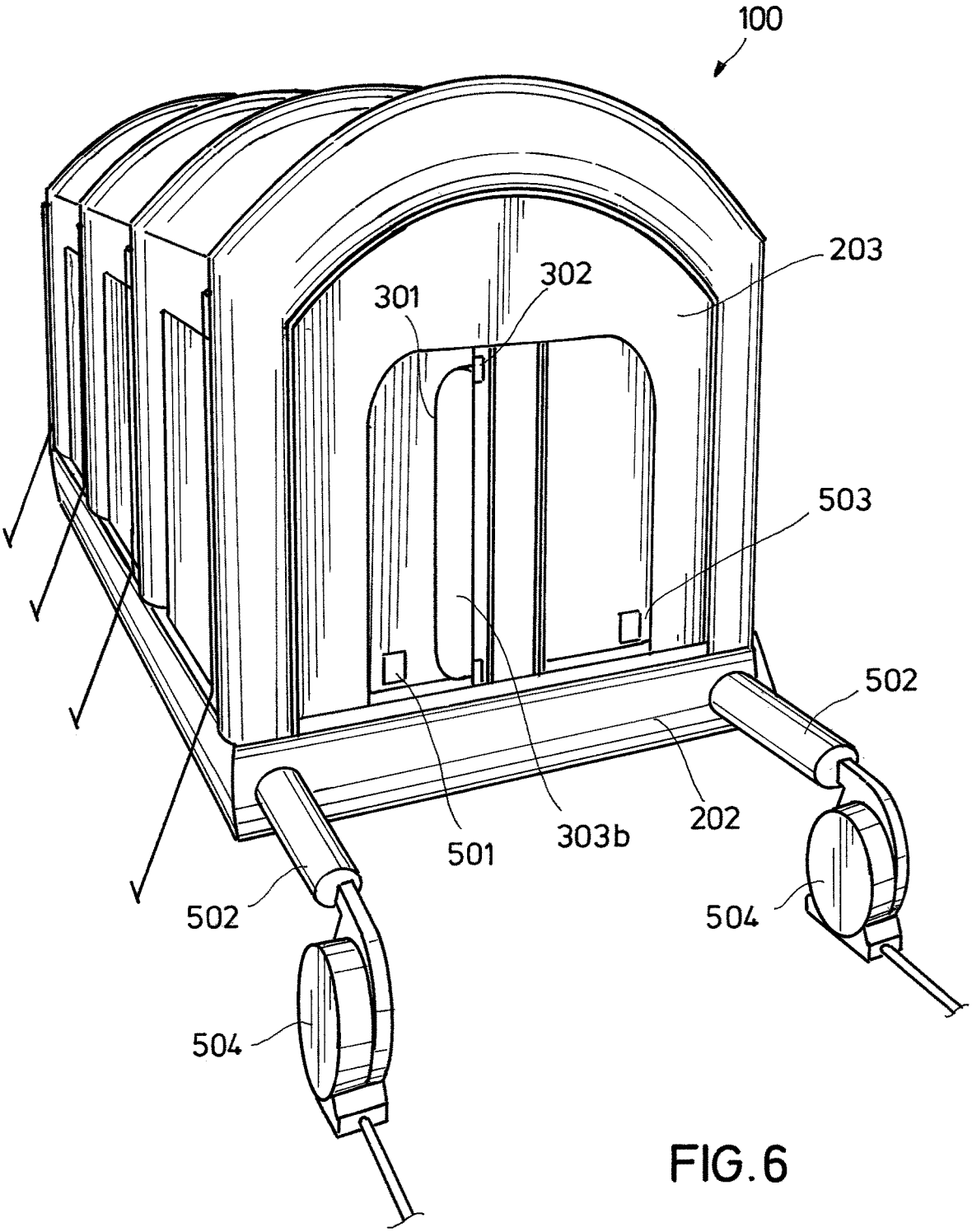
FIG. 6 is a rear perspective view of the positive pressure booth of FIG. 4.

FIG. 6 shows wall 203 comprising a second door 303*b*, one or more orifices 501, and a pair of air inlets 502. Orifices 501 can be resealable openings near the bottom of wall 203. Orifices 501 can comprise fasteners 503 such as a zipper, or hook and loop fabric. Orifices 501 allow power cords and the like to be run in and connect to equipment inside booth 100. Another slit 301, resealable by fastener 302, is shown in door 303*b*.

Figure 7:
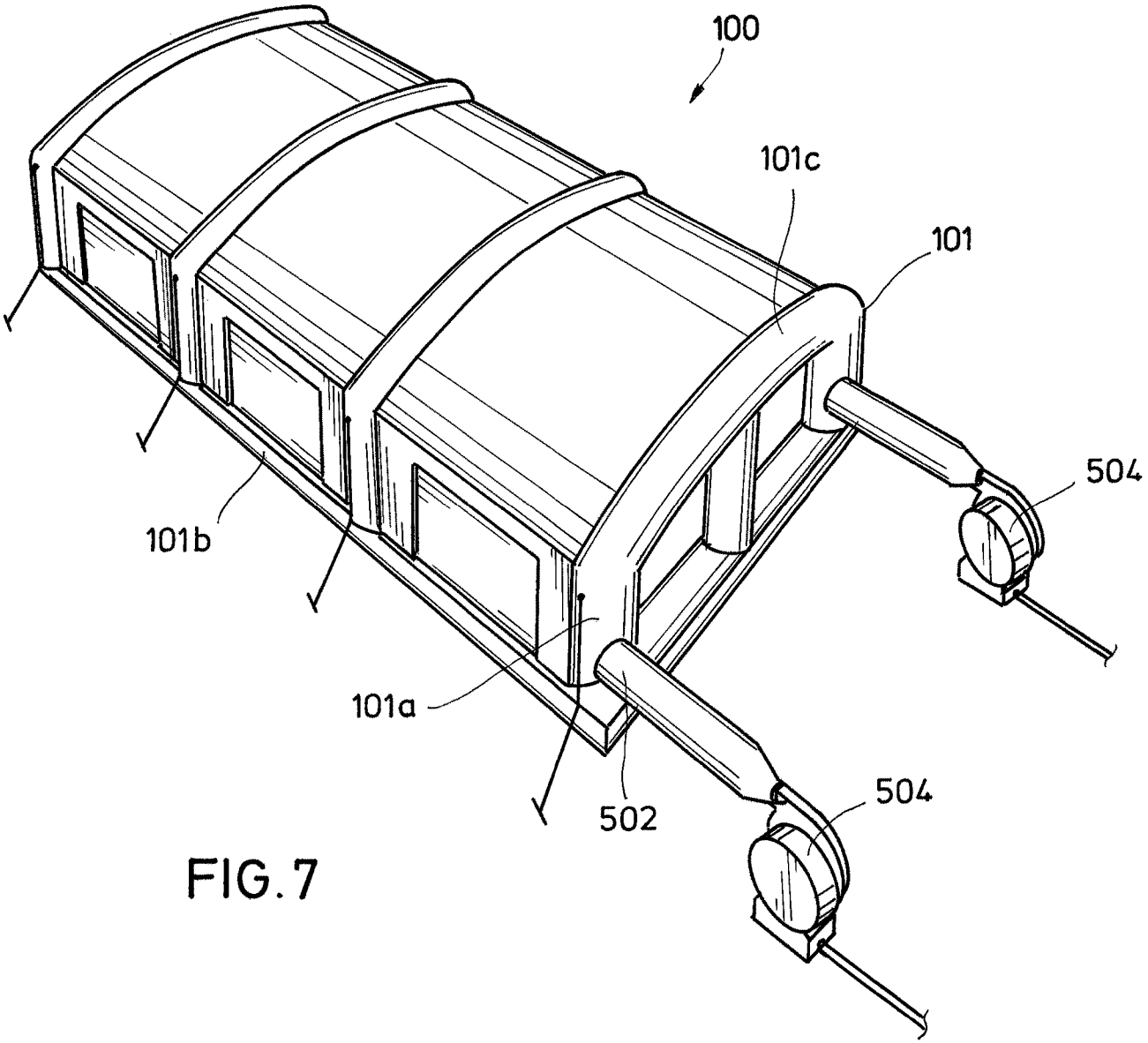
FIG. 7 is an upper perspective view of the positive pressure booth of FIG. 4.

As seen in FIGS. 6 and 7, air inlet 502 allows air pumped by pumps 504 to enter and fill inflatable frame 101. Air pump 504 must be sized according to the characteristics of booth 100. For example, if booth 100 is 16'×16'×9', with twelve air vents 601 each around 3"×3", then one or more air pumps capable of pushing around 5,000 cfm of air would be sufficient to inflate booth 100 without damaging it, and maintain sufficient air turnover within interior space 105. In a preferred embodiment, air within interior space 105 should turn completely at least once every twenty minutes. Though not depicted, tunnel 50 can have one or more air inlets similar to 502 for inflation of tunnel 50. In embodiments in which booth 100 is permanently formed with tunnel 50, they can be connected in such a way that the inflatable portions are in open communication with one another. Thus, air pump 504 can inflate the entire system 10 (both booth 100 and tunnel 50) from a single inlet 502. In that case, there may only be a single inlet in either booth 100 or tunnel 50 for connection to air pump 504. It will be understood that the exact number and placement of air inlets 502 can vary.

The system of the present invention can be used to take medical samples from a person, e.g., an oral swab, a nasal swab, a finger prick, or the like, in a somewhat controlled environment. It will be appreciated that the system of the present invention may also be used to administer vaccines, take a temperature, take blood pressure, and perform a variety of simple tasks without the patient/person needing to leave their vehicle. Tunnel 50 allows for the sample to be taken with a reduced chance of contamination due to airborne particulates.

The walls of tunnel 50 prevent contaminants from entering the area. Optional drapes, covers, or temporary wall structures may be positioned at either or both ends 60 and 62 of the tunnel to further block contaminants from entering tunnel 50, and control the flow of traffic, ensuring one vehicle at a time enters tunnel 50. By way of example only, and without wanting to be limited to the exact process, a person referred to herein as a patient for clarity, can have a diagnostic test performed. Positive pressure booth 100 would hold the various materials and equipment needed for the test and for recordkeeping. This could include, but is not limited to, swabs, equipment for storing samples, a refrigerator, a computer for documenting the patient information, personal protective equipment, etc. The patient would simply drive their vehicle into tunnel 50, park, and roll their window down. One or more medical staff members would exit positive pressure booth 100 and approach the car to perform the designated test, e.g., an oral swap, and take down the patient information. Upon completion, the patient could then continue driving forward to exit tunnel 50. The medical staff member(s) can reenter positive pressure booth 100 and store the test materials, perform further testing steps, e.g., centrifuging the sample, etc. The positive pressure within booth 100 ensures that contaminants, particulates, or the like brought into tunnel 50 with the vehicle do not enter booth 100 as the medical staff members enter and leave booth 100.

The system of the present invention provides multiple advantages. Tunnel 50 allows for a more controlled environment for administering drive through diagnostic tests. The air pressure in booth 100 being higher than that of tunnel 50 and the atmosphere outside booth 100, also known as positive pressure, ensures that contaminants and particles or car exhaust from tunnel 50 or from outside the system do not get blown into booth 100. When opening slit 301, port 300, or orifices 501, the air inside the booth is driven outside, rather than air outside getting pulled in to the booth. This helps maintain a clean environment inside booth 100 and further protects the staff members.

Because booth 100 and tunnel 50 are both inflatable, they can be easily set up, taken down, and relocated as needed. Tunnel 50 and booth 100 will preferably include tie downs and/or anchoring means such that when the system is set up outside, it is able to withstand wind gusts of at least 22 miles per hour, and sustained wind of at least 15 miles per hour.

There are additional optional features which further improve the system of the present invention. The interior of tunnel 50 and/or booth 100 may include straps or fasteners for securing items such as lights such that operations can be performed at night or in dark/dim environments, or signage to provide instructions to patients driving into tunnel 50. Privacy curtains may be draped around the walls of booth 100. One or more wall panels in booth 100 may comprise an emergency exit, as described in U.S. Pat. No. 9,878,342.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. An inflatable drive through tunnel system comprising:

an inflatable tunnel comprising a first inflatable wall, a second inflatable wall, an inflatable roof, an entrance port and an exit port, said tunnel having a side port in said first inflatable wall;

an inflatable booth disposed along said first inflatable wall of said tunnel and having an entry port in register with said side port of said inflatable tunnel, said booth having a positive interior air pressure relative to that of the interior of said inflatable tunnel and the atmosphere outside said system.

2. The system of claim 1, wherein said inflatable booth is removably connected or permanently connected to said inflatable tunnel.

3. The system of claim 2, wherein said inflatable booth is permanently connected to said inflatable tunnel.

4. The system of claim 3, wherein both said inflatable booth and said inflatable tunnel can be inflated through an air inlet positioned on either of said inflatable booth or said inflatable tunnel.

5. The system of claim 1, wherein said inflatable booth comprises an inflatable frame having a plurality of horizontal and vertical inflatable beams, at least one air vent positioned in at least one of said inflatable beams, said air vent allowing air to pass from an inside of said inflatable frame to the interior of said inflatable booth to create said positive interior air pressure.

6. The system of claim 5, wherein said inflatable booth further comprises a peripherally extending wall system.

7. The system of claim 6, wherein there is at least one exhaust panel positioned in said peripherally extending wall system.

8. The system of claim 6, wherein there is at least one resealable orifice in said peripherally extending wall system to allow power cords or the like to pass from the interior of said inflatable booth to the exterior of said inflatable booth.

9. The system of claim 1, wherein at least one drape, cover, or temporary wall is positioned at either or both entrance and exit ports of said inflatable tunnel.

* * * * *